US006666142B1

(12) United States Patent
Pearce et al.

(10) Patent No.: US 6,666,142 B1
(45) Date of Patent: Dec. 23, 2003

(54) SWITCH KEY TOOL FOR USE IN CHANGING SWITCH KNOB SETTINGS ON A LASER GUIDED BOMB

(75) Inventors: John Gregory Pearce, Oxnard, CA (US); Gregory V. Brodbeck, Camarillo, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/303,173

(22) Filed: Nov. 25, 2002

(51) Int. Cl.[7] ..... F42B 12/00
(52) U.S. Cl. ..... 102/293
(58) Field of Search ..... 102/293, 382–397; 89/1.8, 1.812, 1.813, 1.814, 28.05, 28.1; 244/3.1, 3.2, 3.3, 3.21; 7/170

(56) References Cited

U.S. PATENT DOCUMENTS 4,290,364 A * 9/1981 Weidenhagen et al. ..... 102/384
4,334,132 A * 6/1982 Poole ..... 200/566
4,408,346 A * 10/1983 Bauer ..... 455/175.1
4,408,537 A * 10/1983 Fortier ..... 102/395
4,419,639 A * 12/1983 Bauer et al. ..... 334/7
4,567,828 A * 2/1986 Campagnuolo et al. ..... 102/208
4,620,484 A * 11/1986 Livne ..... 102/395
4,960,032 A * 10/1990 Huetter ..... 89/1.51
5,004,183 A * 4/1991 Jarrett ..... 244/3.11
5,204,511 A * 4/1993 Baitz et al. ..... 235/145 R
5,233,716 A * 8/1993 Hicks ..... 7/165
5,238,204 A * 8/1993 Metz ..... 244/3.15
5,379,966 A * 1/1995 Simeone et al. ..... 244/3.11
5,507,452 A * 4/1996 Mayersak ..... 244/3.15
5,621,251 A * 4/1997 Yamazaki ..... 307/10.2
5,826,819 A * 10/1998 Oxford ..... 244/3.14
6,157,875 A * 12/2000 Hedman et al. ..... 701/1
6,257,031 B1 * 7/2001 Misner ..... 70/252

* cited by examiner

*Primary Examiner*—Peter M. Poon
*Assistant Examiner*—David J Parsley
(74) *Attorney, Agent, or Firm*—David S. Kalmbaugh

(57) ABSTRACT

A switch key tool for setting the pulse repetition frequency code on a laser guided bomb. The switch key tool allows the user to set the pulse repetition frequency code when the laser guided bomb has its switch knobs and also when the laser guided bomb is missing its switch knobs.

15 Claims, 3 Drawing Sheets

SWITCH KEY TOOL FOR USE IN CHANGING SWITCH KNOB SETTINGS ON A LASER GUIDED BOMB

BACKGROUND OF THE INVENTION

1. Field of the Invention

The present invention relates generally to a hand tool which allows a user to change the switch settings on a laser guided bombs and the like. More particularly, the present invention relates to a hand tool which allows a user to change the switch settings on a laser guided bomb when the PRF (pulse repetition frequency) code switch knobs on a laser guided are broken or lost during flight.

2. Description of the Prior Art

Laser Guided Bombs and Guided Bomb Units include guided control units, computer control groups or control sections which control the operation of the bombs. Each guided control unit or computer control group has a plurality of Pulse Repetition Frequency (PRF) Code switch knobs which are used to set the pulse repetition frequency for the Laser Guided Bomb.

There have been several occurrences in the past where the PRF code switch knobs have either been broken or lost. Without the switch knobs the laser guided bombs are rendered nonoperative since the switch knobs cannot be reattached externally. The PRF switch knobs are fabricated from plastic or other polymer and are secured to the knobs shaft by a retaining set screw. The threaded area of the knob which receives the set screw expands over time which loosens the set screw causing the knob to separate from its shaft and the bomb.

In addition, repeated use of the bomb for testing and harsh environments will often cause the switch knobs to separate from their shafts again rendering the laser guided bombs non-operative.

Currently, when the switch knobs are missing from a laser guided bomb, the bomb is sent to a rework facility for replacement of the missing switch knobs. Since the bombs have to be dis-assembled to replace the missing switch knobs and there are shipping cost associated with the transfer of a bomb to a rework facility, the cost to replace a bomb's switch knobs can be several thousand dollars.

Accordingly, there is a need to provide an apparatus or tool which will allow a user to set the pulse repetition switch knobs on a laser guided bomb to a pulse repetition code for the laser guided bomb. In addition, the tool needs to have the capability of allowing a user to set the pulse repetition frequency for a laser guided bomb when one or more of the PRF switch knobs are broken or missing. It is also desirable that the tool be inexpensive, easy to fabricate, lightweight and portable.

SUMMARY OF THE INVENTION

The present invention overcomes some of the disadvantages of the past including those mentioned above in that it comprises a relatively simple in design yet highly effective and efficient switch key tool which allows a user to change the switch knob setting on a laser guided bomb and thereby change the pulse repetition frequency for the bomb.

The switch key tool has a cylindrical shaped body, a rectangular shaped member at one end and a "D" shaped opening at the opposite end of the tool. A user inserts the rectangular member into an elongated opening within the switch knob to change the switch knob setting. A first elongated white identification line on the black surface of the housing for switch key tool identifies for the user the current setting of the switch knob and provides a means for the user to set the switch knob to the new/required setting.

When the switch knob is missing, the user slides the "D" shaped opening of switch key tool over the shaft for the missing switch knob to change the PRF code setting for the missing knob. A second elongated white identification line on the black surface of the housing for switch key tool identifies for the user the current setting when the switch knob is missing and provides a means for the user to set the switch knob's shaft to the new/required setting.

The switch key tool also has a U shaped handle which allows a user to attach the tool to a utility belt.

DETAILED DESCRIPTION OF THE PREFERRED EMBODIMENT

Figure 1:
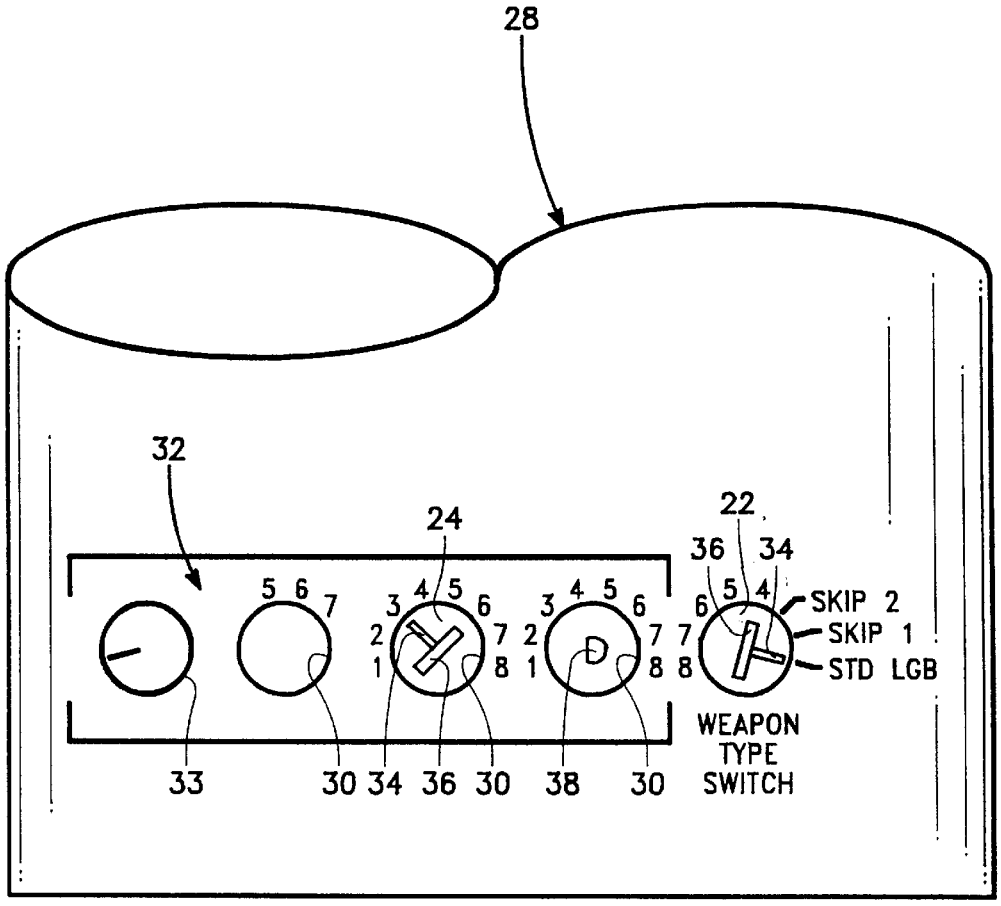
FIG. 1 illustrates a partial sectional view of a laser guided bomb including the switch knobs for setting the pulse repetition frequency code for the bomb.
Figure 2:
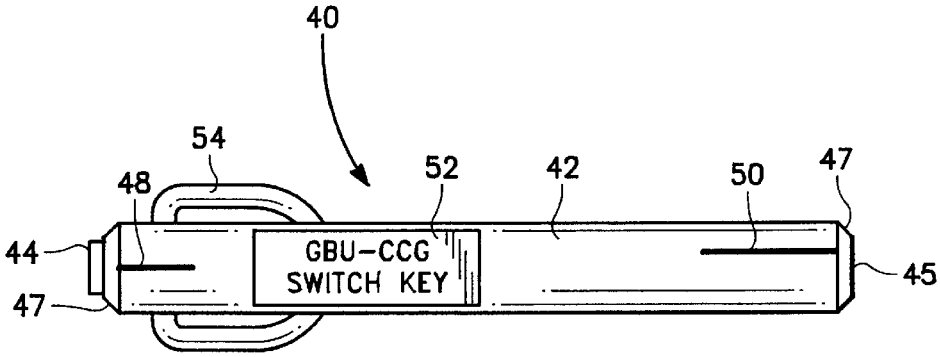
FIGS. 2 and 3 illustrate side views of the switch key tool for use in changing switch knob settings on a laser guided bomb.
Figure 3:
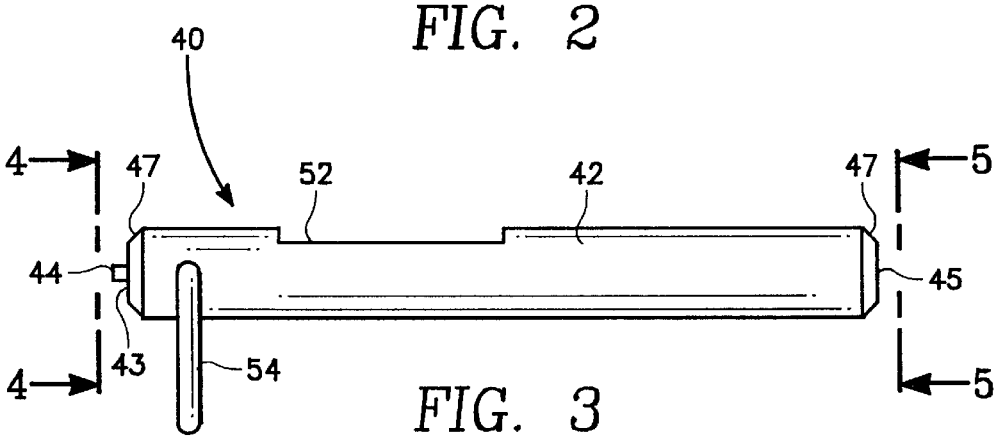
Figure 4:
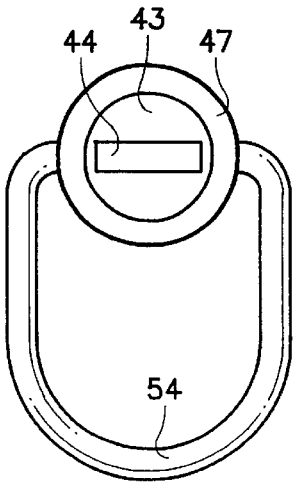
FIGS. 4 and 5 illustrate end views of the switch key tool depicted in FIGS. 2 and 3.
Figure 5:
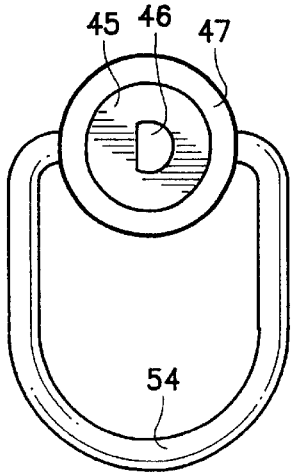

Referring to FIGS. 1, 2 and 3, laser guide bombs and guided bomb units have a plurality of switch knobs 22 and 24 which allow a user to set the pulse repetition code for the bomb 28 prior to deployment of bomb 28 for testing or some other purpose. Each switch knob 22 and 24 Us recessed within a cylindrical shaped opening 30 extending from the outer surface 32 of the bomb 28 in the manner illustrated in FIG. 1. Around the periphery of the cylindrical shaped openings 30 are numbers or reference numerals by which a user sets the pulse repetition frequency code for the laser guided bomb 30. For example, the numbers around switch knob 24 are 1, 2, 3, 4, 5, 6, 7 and 8, while the numbers around switch knob 22 are 4, 5, 6, 7 and 8. There is also a "SKIP 1" and "SKIP 2" as well as a "STD LGB" around switch knob 22.

The opening 30 with the numbers 5, 6 and 7 is empty. Adjacent this opening on the surface 32 of bomb 28 is a circle 33 with a line extending inward.

As shown in FIG. 1, the opening 30 between switch knobs 22 and 24 is missing its switch knob leaving only a switch knob shaft 38 within the opening.

Each switch knob has a white one digit code identification line 34 on its top surface which identifies the position setting for the switch knob. The identification line 34 for each switch knob extends from the center of the knob to its periphery and is generally engraved into the top surface of switch knob. Each switch knobs also has an elongated slot 36 which is centrally located within each switch knob and is positioned perpendicular to the identification line 34. A tool, such as the switch key tool comprising the present invention when inserted into slot 34 allows the user to set the switch knob to the desired PRF code bit.

The switch knobs 22 and 24 are secured to their shafts by a set screw. The threaded area of the knob which receives the set screw expands over time which loosens the set screw causing the knob to separate from its shaft and the bomb.

Referring to FIGS.1, 2 and 3, the switch key tool, designated generally by the reference numeral 40, is used to set the switch knobs 22 and 24 to the desired pulse repetition code. In addition, the opening 30 between switch knobs 22 and 24 is missing its switch knob leaving only generally "D" shaped switch knob shaft 38 within the opening 30. The switch key tool 40 can be used to set the switch knob shaft to the position associated with a one digit PRF code number the user needs to enter to activate the laser guided bomb.

Referring to FIGS. 1–5, switch key tool 40 has a cylindrical shaped body 42 which is approximately five inches in length and has a diameter of approximately six tenths of an inch. One end 43 of the cylindrical shaped body 42 of switch key tool 40 has a generally rectangular shaped member 44 which is designed to fit within the elongated slot 36 for each switch knob 22 and 24. Rectangular shaped member 44 is approximately 0.350 inches wide by 0.100 inches deep which insures that member 44 will fit securely slot 36 for each switch knob 22 and 24. The other end 45 of the cylindrical shaped body 42 of switch key tool 30 has an opening 46 which is "D" shaped and is designed to slide over the switch knob shaft 38 of a missing switch knob. A portion 47 of each end 43 and 45 is angled at approximately 45° for approximately one tenth of inch to align switch key tool 40 with openings 30. This makes for easy insertion of the switch key tool 40 into each of the openings 30 within the outer surface 32 of the bomb 28.

At this time it should be noted that switch key tool 40 is fabricated from aluminum.

Positioned at the ends of cylindrical shaped body 42 are a pair of engraved code bit identification lines 48 and 50. Each identification line 48 and 50 is white in color such that the lines 48 and 50 stand out from the body of switch key tool 30. Lines 48 and 50 are perpendicular to member 44 and are in alignment with the one digit code identification line 34 on each of the switch knobs 22 and 24 when member 44 is inserted in the slot 36 for one of the switch knobs 22 or 24. Thus, the identification lines function in exactly the same manner as the white one digit code identification line 34 on the switch knobs 22 and 24. This allows a user to set the pulse repetition frequency (PRF) code for the laser guided bomb regardless of whether or not the switch knobs are broken or missing.

The cylindrical shaped body 42 of switch key tool 40 has a flat surface 52 which is indented into the surface of body 42 about one tenth of an inch. Engraved lettering in the flat surface 52 read as follows: "GBU-CCG" and "SWITCH KEY" with "SWITCH KEY" being positioned below "GBU-CCG". The lettering is white in color to distinguish the lettering from the black of the cylindrical shaped body 42. The lettering allows the user to identify the tool and its intended use which is to set the PRF code for the laser guided bomb 28. Positioned 180° from the engraved lettering on flat surface 52 is the part number "1393AS450" for switch key tool 40. This lettering is also engraved and white in color to distinguish the lettering from the black of the cylindrical shaped body 42.

The switch key tool 40 has a U-shaped handle 54 in proximity to end 43. U-shaped handle 54 provides a means for a user to carry the switch key tool 40 on a tool belt.

Figure 6:
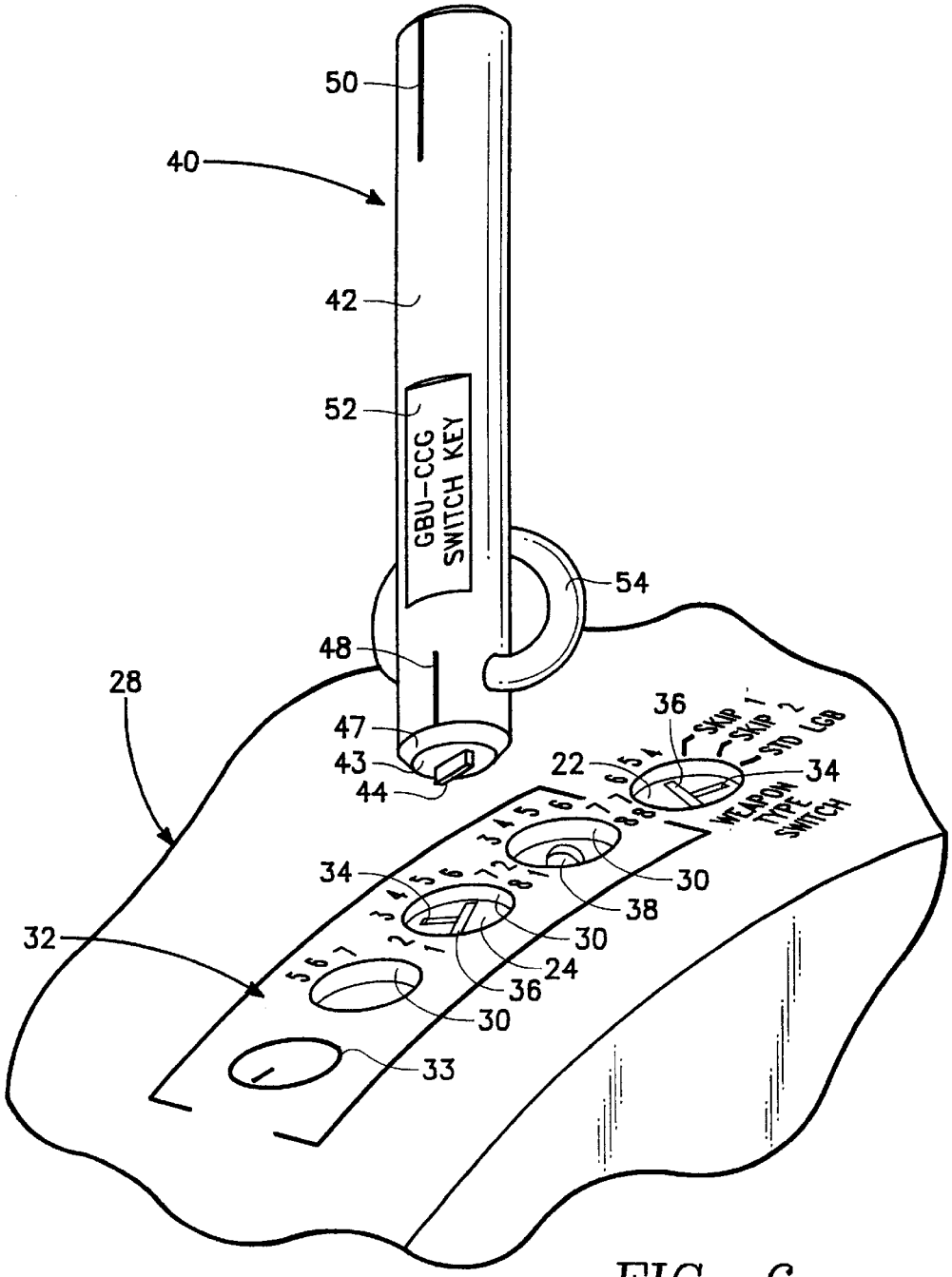
FIG. 6 is a perspective view of the switch key tool being used to change the pulse repetition frequency for a laser guided bomb

Referring to FIG. 6, switch key tool 40 is shown in proximity to the switch knob 24. The user then inserts member 44 of switch key tool 40 into the elongated slot 36 within switch knob 36 to change the PRF code setting for switch knob 36. Code bit identification line 48 identifies for the user of switch key code tool 40 the particular setting at which the switch knob 36 currently resides and also allows the user to verify that the new setting for switch knob 36. Thus, for example, when the user needs to change the setting for knob 24 from its current setting of "3" (as best seen in FIG. 1) to a setting of "6" the user will rotate switch key tool 40 clockwise until line 48 is in alignment with the numeral "6".

From the foregoing it may readily be seen that the present invention comprises a new, unique and exceedingly useful switch key tool for use in changing switch settings on a laser guided bomb which constitutes a considerable improvement over the known prior art. Obviously, many modifications of the present invention are possible in light of the above teachings. It is therefore to be understood that within the scope of the appended claims that the invention may be practiced otherwise than as specifically described.

What is claimed is:

1. A switch key tool for setting a pulse repetition frequency (PRF) code for a laser guided bomb, said laser guided bomb having a plurality of switch knobs to set said PRF code which has a plurality of PRF code bits, said switch knobs setting the plurality of PRF code bits for said PRF code, said switch key tool comprising:

(a) a cylindrical shaped body having a dark colored surface;

(b) a rectangular shaped member affixed to one end of said cylindrical shaped member, said rectangular shaped member allowing a user to set each of said plurality of switch knobs by inserting said rectangular shaped member into an elongated slot within each of said switch knobs and rotating said switch key tool to aligned with one of a plurality of PRF code numbers located on the surface of said laser guided bomb, said PRF code numbers being representative of the PRF code bits for said PRF code;

(c) a D-shaped opening positioned at the other end of said cylindrical shaped member, said D-shaped opening allowing a user to set a switch knob shaft for a switch knob which is disconnected and missing from said laser guided bomb by sliding the D-shaped opening over said switch knob shaft and rotating said switch key tool to align with another of said plurality of PRF code numbers; and (d) a pair of light colored identification lines formed within said cylindrical shaped body, one of said pair of light colored identification lines being positioned at each end of said cylindrical shaped body, said pair of light colored identification lines allowing a user to align said switch key tool with each of said plurality of PRF code numbers and thereby enter said PRF code into said laser guided bomb.

2. The switch key tool of claim 1 wherein said pair of light colored identification lines are white and said cylindrical shaped body is black to provide for a visual contrast between said pair of light colored identification lines and said cylindrical shaped body.

3. The switch key tool of claim 1 further comprising a U shaped handle affixed to said cylindrical shaped body.

4. The switch key tool of claim 1 wherein an outer portion of each end of said cylindrical shaped is angled at approximately forty five degrees.

5. The switch key tool of claim 1 further comprising a rectangular shaped flat surface indented into said cylindrical shaped body about one tenth of an inch, said flat surface having engraved lettering which identifies the switch key tool and an intended use for said switch key tool.

6. The switch key tool of claim 1 wherein said cylindrical shaped cylinder has a length of approximately five inches and a diameter of approximately six tenths of an inch.

7. The switch key tool of claim 1 wherein said cylindrical shaped body and said rectangular shaped member are fabricated from aluminum.

8. A switch key tool for setting a pulse repetition frequency (PRF) code for a laser guided bomb, said laser guided bomb having a plurality of switch knobs to set said PRF code which has a plurality of PRF code bits, said switch knobs setting the plurality of PRF code bits for said PRF code, said switch key tool comprising:

(a) a cylindrical shaped body having a black surface;

(b) a rectangular shaped member affixed to one end of said cylindrical shaped member, said rectangular shaped member allowing a user to set each of said plurality of switch knobs by inserting said rectangular shaped member into an elongated slot within each of said switch knobs and rotating said switch key tool to aligned with one of a plurality of PRF code numbers located on the surface of said laser guided bomb, said PRF code numbers being representative of the PRF code bits for said PRF code;

(c) a D-shaped opening positioned at the other end of said cylindrical shaped member, said D-shaped opening allowing a user to set a switch knob shaft for a switch knob which is disconnected and missing from said laser guided bomb by sliding the D-shaped opening over said switch knob shaft and rotating said switch key tool to align with another of said plurality of PRF code numbers;

(d) a pair of white identification lines formed within said cylindrical shaped body, one of said pair of white identification lines being positioned at each end of said cylindrical shaped body, said pair of white identification lines allowing a user to align said switch key tool with each of said plurality of PRF code numbers and thereby enter said PRF code into said laser guided bomb; and (e) a U shaped handle affixed to said cylindrical shaped body;

(f) wherein said cylindrical shaped body and said rectangular shaped member are fabricated from aluminum.

9. The switch key tool of claim 8 wherein an outer portion of each end of said cylindrical shaped is angled at approximately forty five degrees.

10. The switch key tool of claim 8 further comprising a rectangular shaped flat surface indented into said cylindrical shaped body about one tenth of an inch, said flat surface having engraved lettering which identifies the switch key tool and an intended use for said switch key tool.

11. The switch key tool of claim 8 wherein said cylindrical shaped cylinder has a length of approximately five inches and a diameter of approximately six tenths of an inch.

12. A method for setting a pulse repetition frequency (PRF) code for a laser guided bomb having a plurality of switch knobs by utilizing a switch key tool comprising the steps of:

(a) inserting a rectangular shaped member positioned at one end of said switch key tool into an elongated slot within each of said switch knobs;

(b) rotating said switch key tool to align with one PRF code number of a plurality of PRF code numbers located on the surface of said laser guided bomb at the periphery of each of said switch knobs, said PRF code numbers being representative of PRF code bits for said PRF code;

(c) aligning a first identification line included within said switch key tool with said one PRF code number for each of said switch knobs to enter said PRF code into said laser guided bomb;

(d) sliding a D-shaped opening positioned at an opposite end of said switch key tool over a switch knob shaft for a switch knob which is disconnected and missing from said laser guided bomb;

(e) rotating said switch key tool to align with another PRF code number of said plurality of PRF code numbers; and (f) aligning a second identification line included within said switch key tool with said another PRF code number to enter said PRF code number for said switch knob which is disconnected and missing from said laser guided bomb.

13. The method of claim 12 wherein said switch key tool comprises a cylindrical shaped cylinder which has a length of approximately five inches and a diameter of approximately six tenths of an inch, said cylindrical shaped body having said rectangular shaped member positioned at the one end thereof and the D-shaped opening at the opposite end thereof.

14. The switch key tool of claim 13 further comprising a rectangular shaped flat surface indented into said cylindrical shaped body about one tenth of an inch, said flat surface having engraved lettering which identifies the switch key tool and an intended use for said switch key tool.

15. The switch key tool of claim 13 further comprising a U shaped handle affixed to said cylindrical shaped body.

* * * * *